US008109566B2

(12) United States Patent
Koh

(10) Patent No.: US 8,109,566 B2
(45) Date of Patent: Feb. 7, 2012

(54) COLLAPSIBLE DESK ASSEMBLY

(76) Inventor: Tuang Hock Koh, Taichung (TW)

( * ) Notice: Subject to any disclaimer, the term of this patent is extended or adjusted under 35 U.S.C. 154(b) by 274 days.

(21) Appl. No.: 12/611,128

(22) Filed: Nov. 3, 2009

(65) Prior Publication Data

US 2011/0101740 A1 May 5, 2011

(51) Int. Cl.
*A47B 39/00* (2006.01)

(52) U.S. Cl. ..... 297/145; 297/155; 297/173; 297/162

(58) Field of Classification Search ..... 297/155, 297/162, 160, 173
See application file for complete search history.

(56) References Cited

U.S. PATENT DOCUMENTS 3,547,488 A * 12/1970 Barnes ..... 297/162
3,751,789 A * 8/1973 Fink ..... 29/434
3,784,249 A * 1/1974 Hendrickson et al. ..... 297/162
5,087,096 A * 2/1992 Yamazaki ..... 297/145
6,017,085 A * 1/2000 LaCroix et al. ..... 297/173
6,073,997 A * 6/2000 Koh ..... 297/173
6,224,149 B1 * 5/2001 Gevaert ..... 297/162
6,375,257 B1 * 4/2002 Wooding et al. ..... 297/162
6,916,065 B2 * 7/2005 Park ..... 297/217.1
7,695,061 B2 * 4/2010 Olarte ..... 297/162
2008/0197678 A1 * 8/2008 Olarte ..... 297/162

* cited by examiner

*Primary Examiner* — David Dunn
*Assistant Examiner* — Erika Garrett

(57) ABSTRACT

A collapsible desk assembly includes a desk board, an elbow joint, a positioning board, and a connecting portion. The elbow joint has a groove defined therein and is mounted to the desk board. The positioning board has a pin disposed thereon and the positioning board is connected to the elbow joint. The pin is inserted into the groove. A pivoting shaft is extending from the positioning board. The connecting portion has a receiving hole defined therein for receiving the pivoting shaft. A bolt is inserted into the receiving hole and passing through the pivoting shaft, and is threaded to the elbow joint. When the desk board is descended, the positioning board is rotated downwardly and blocking the elbow joint from pivotally bending relative to the connecting portion, such that the desk board is stably suspended beside the connecting portion.

4 Claims, 9 Drawing Sheets

COLLAPSIBLE DESK ASSEMBLY

BACKGROUND OF THE INVENTION

1. Field of the Invention

The present invention relates to a collapsible desk assembly, more particularly, to a collapsible desk assembly adapted to be pivotally assembled to a chair.

2. Description of Related Art

A conventional collapsible desk assembly commonly known in accordance with the prior art comprises a desk board which is pivotally mounted to one side of an armrest of a chair by a pivotal unit. The desk board is pivotally flipped to a top of the armrest, such that the desk board is flatly placed above the armrest, allowing a user to use the desk board for reading or writing purpose. When not in use, the desk board is reversely flipped to the side of the armrest and is vertically suspended beside the armrest.

However, the conventional collapsible desk assembly bears several defects. First of all, the pivotal unit is mounted to the side of the armrest, when not in use, the desk board is reversely flipped to the side of the armrest and is vertically suspended beside the armrest, such that a slit formed between the pivotal unit and the armrest of the chair is emerged. When in sitting position, the user may customarily place his/her arm on the armrest and the slit, or unwarily put his/her fingers into the slit. When the user adjusts sitting position, he/she may unintentionally touch the desk board suspended beside the armrest, causing the pivotal unit to slightly pivotally shift relative to the armrest due to the swing of the desk board. A slight shifting of the pivotal unit will lead to a variation in a size of the slit, and the slit may clamp onto the user's arm or fingers causing unwanted injuries such as bleeding, or laceration. Therefore, the conventional collapsible desk assembly is unsafe to use.

The present invention has arisen to obviate/mitigate the disadvantages of the conventional collapsible desk assembly.

SUMMARY OF THE INVENTION

The present invention relates to a collapsible desk assembly which comprises a desk board, an elbow joint, a positioning board, and a connecting portion which is adapted to be connected to an armrest of a chair. The desk board is provided for adapting to pivotally connect to the armrest of a chair. A supporting board is mounted to a backside of the desk board. The supporting board has a receiving space defined therein for receiving the elbow joint. The elbow joint includes an upper portion and a lower portion which is pivotally connected to the upper portion. A base is mounted on the upper portion. The base has a trench defined therein. A push block is screwedly received in the trench. A block cover caps the push block. A cover casing completely covers the base. The cover casing has an opening defined therein for partially receiving the block cover. The block cover is abutted against the connecting portion. An position of the block cover with the push block relative to the cover casing is adjustable due to the push block is screwed in/out from the trench. The upper portion is slightly pushed away from the connecting portion, such that the block cover is protruded from the cover casing. An interval between the upper portion and the connecting portion is changed, adjusting a tilting angle of the desk board relative to the connecting portion. The lower portion is threadedly connected to the connecting portion. A securing post is simultaneously passing through the upper portion and the lower portion to be a pivot of the elbow joint. An arc-shaped grooved is defined in the lower portion. The positioning board is connected to the elbow joint. The positioning board is elongated-shaped. The positioning board has a pin disposed on a first side thereof. The pin is inserted into the arc-shaped groove of the lower portion. The pin is able to slide along the arc-shaped groove relative to the positioning board. A pivoting shaft extends from a second side of the positioning board opposite to the first side. The connecting portion has a receiving hole laterally defined therein and extending therethrough for receiving the pivoting shaft. A sleeve is sleeving on the pivoting shaft for assisting the pivoting shaft to pivotally rotate relative to the connecting portion. A bolt is sequentially passing through the receiving hole and the pivoting shaft, and is screwed to the elbow joint.

When the elbow joint is pivotally rotated upwardly relative to the connecting portion, the desk board is upwardly lifted with the upper portion. The pin is abutted against a second end of the arc-shaped groove of the lower portion, driving the positioning board to pivotally rotate upwardly. When the desk board is lifted above the connecting portion, the upper portion is pivotally perpendicularly bent relative to the lower portion; such that the desk board is flipped to a top of the connecting portion. When the desk board is descended, the pin is abutted against a first end of the arc-shaped groove, driving the positioning board to pivotally rotate downwardly relative to the connecting portion. The elbow joint and the positioning board are pivotally rotated downwardly relative to the connecting portion. The positioning board blocks the upper portion from pivotally bending relative to the lower portion, such that the upper portion is confined from arbitrarily pivoting relative to the lower portion when the desk board is descended. Therefore, the desk board is stably suspended beside the connecting portion.

The present invention will become more obvious from the following description when taken in connection with the accompanying drawings which show, for purposes of illustration only, a preferred embodiment in accordance with the present invention.

DETAILED DESCRIPTION OF THE INVENTION

Figure 1:
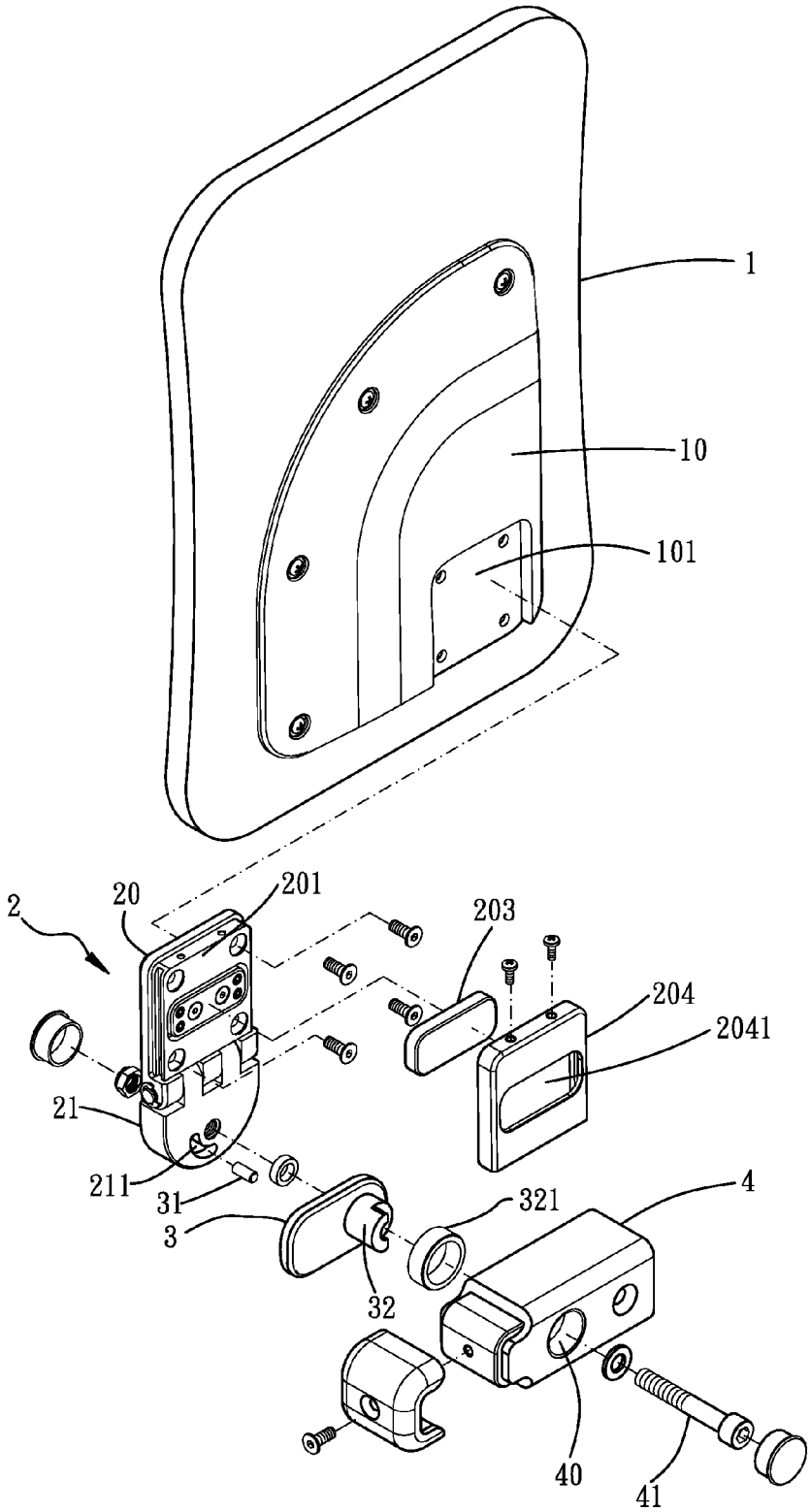
FIG. 1 is an exploded perspective view to show the collapsible desk assembly in accordance with the present invention.
Figure 2:
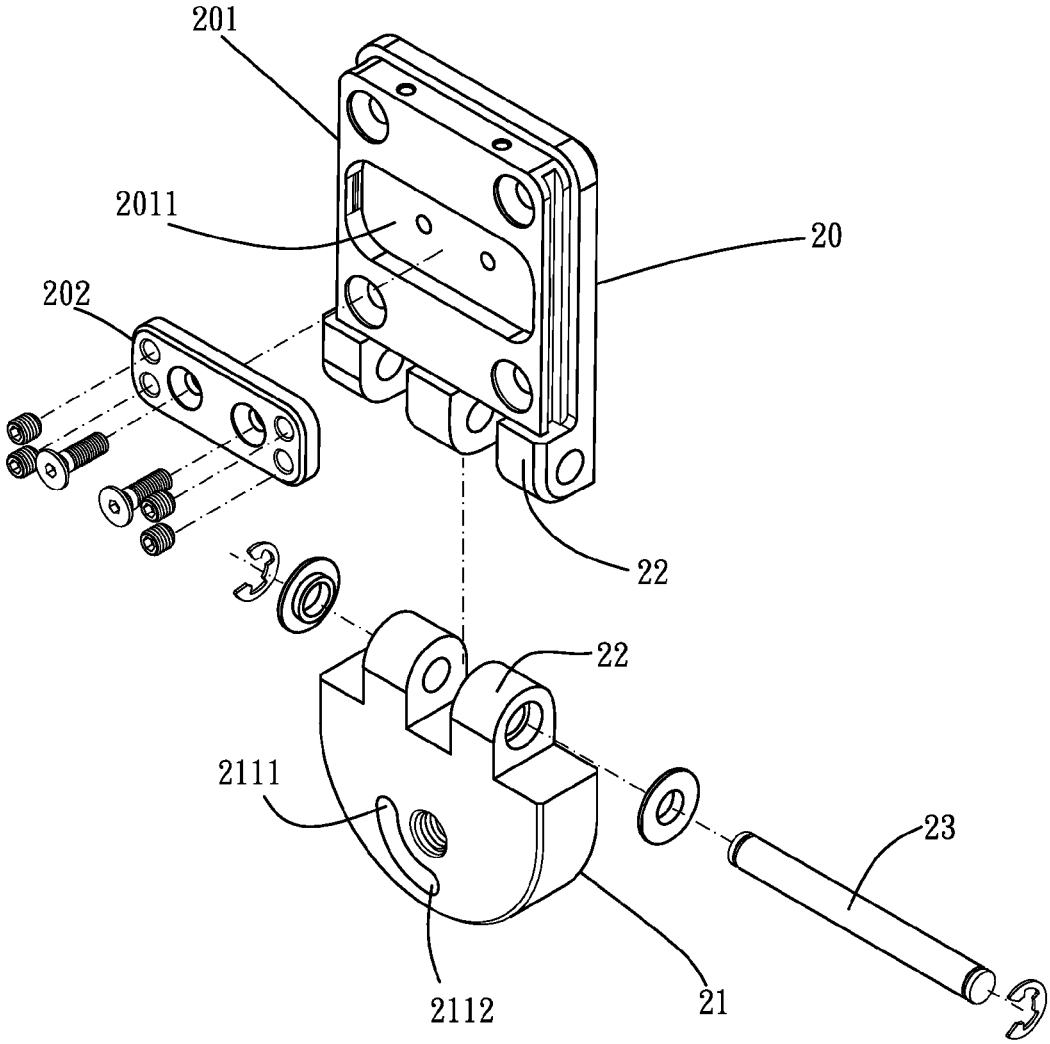
FIG. 2 is an exploded perspective view of the elbow joint of the collapsible desk assembly in accordance with the present invention.
Figure 3:
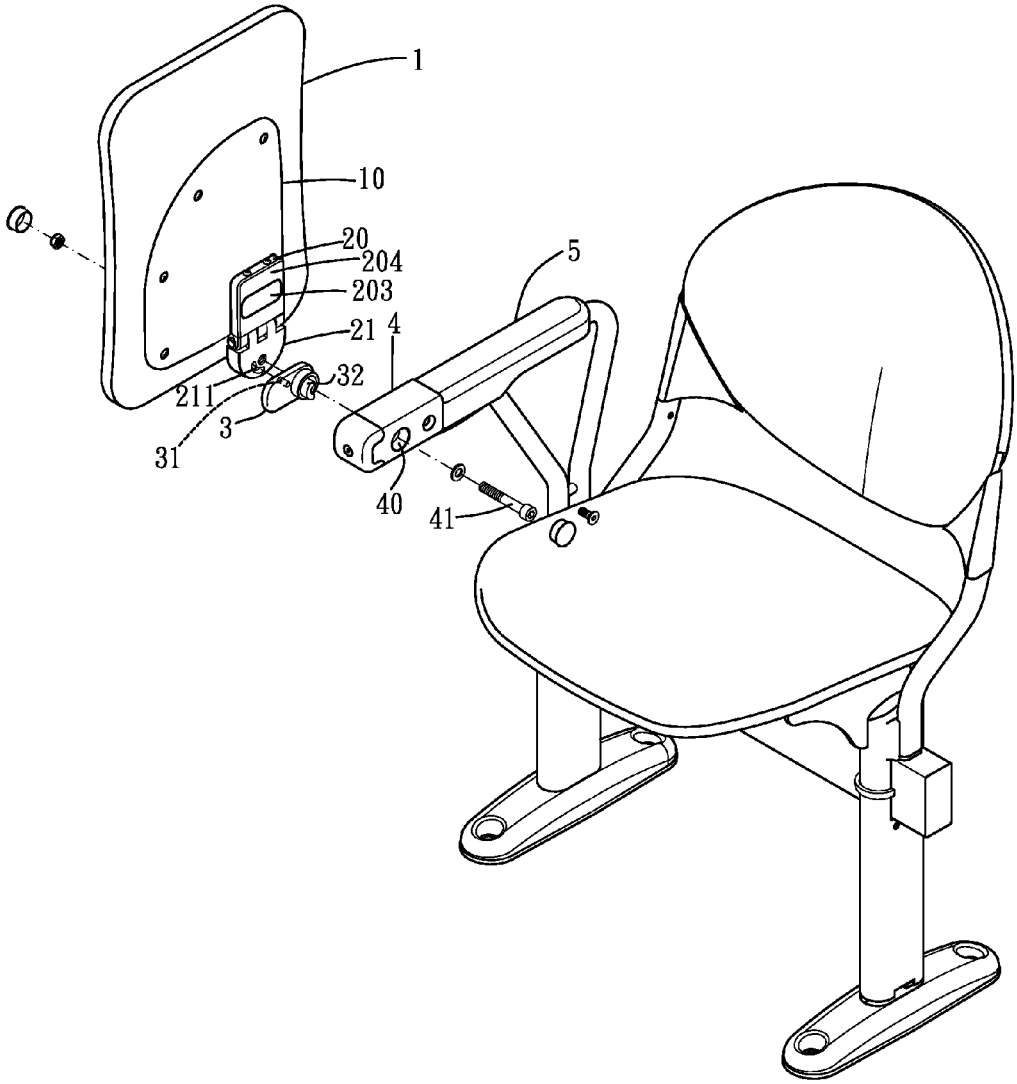
FIG. 3 is a partially-exploded perspective view of the collapsible desk assembly in accordance with the present invention when assembling with an armrest of a chair.
Figure 4:
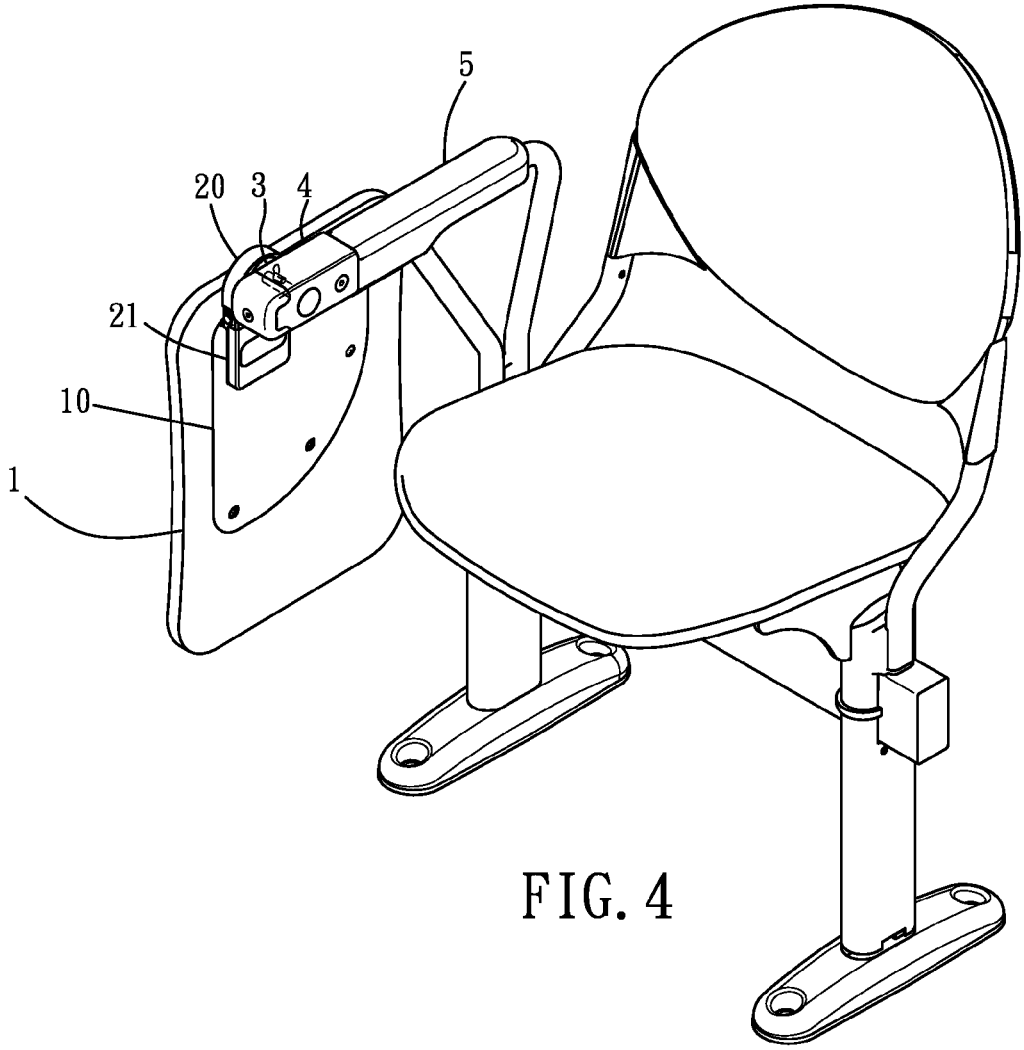
FIG. 4 is an assembled perspective view of the collapsible desk assembly in accordance with the present invention when assembling with the armrest of a chair.
Figure 5:
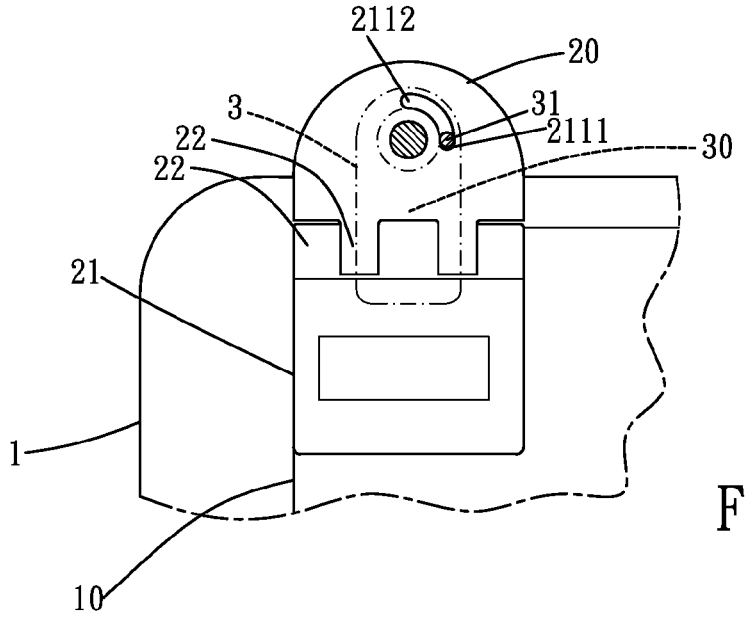
FIG. 5 is a plane view of the elbow joint of the collapsible desk assembly in accordance with the present invention, showing a position of the elbow joint relative to the desk board when the desk board is suspended.

Referring to the drawings and initially to FIGS. 1 to 3, a collapsible desk assembly in accordance with the present invention comprises a desk board 1, an elbow joint 2, a positioning board 3, and a connecting portion 4 which is adapted to be connected to an armrest 5 of a chair. The desk board 2 is provided for adapting to pivotally connect to the armrest 5 of the chair. The desk board 1 has a supporting board 10 which is mounted to a backside thereof. The supporting board 10 has a receiving space 101 defined therein for receiving the elbow joint 2. The elbow joint 2 includes an upper portion 20 and a lower portion 21 which is pivotally connected to the upper portion. The upper portion 20 is mounted to the receiving space 101 of the supporting board 10. A base 201 is mounted to the upper portion 20. The base 201 has a trench 2011 defined therein. A push block 202 is screwedly received in the trench 2011. A block cover 203 caps the push block 202. A cover casing 204 completely covers the base 201. The cover casing 204 has an opening 2041 defined therein and corresponding to the block cover 203 for partially receiving the block cover 203. The block cover 203 is abutted against the connecting portion 4. A plurality of pivoting lugs 22 extends downwardly from a lower end of the upper portion 20. The lower portion 21 is threadedly connected to the connecting portion 4. The lower portion has a plurality of pivoting lugs 22 extending upwardly therefrom. The pivoting lugs 22 of the lower portion 21 are intersectingly engaged with the pivoting lugs 22 of the upper portion 20. A securing post 23 is simultaneously passing through the pivoting lugs 22 of the upper portion 20 and the lower portion 21 to be a pivot of the elbow joint 2, such that the upper portion 20 is able to pivotally bend relative to the lower portion 21. An arc-shaped groove 211 is defined in the lower portion. The positioning board 3 is elongated-shaped and is connected to the elbow joint 2. The positioning board 3 has a pin 31 disposed on a first side thereof. The pin 31 is inserted into the arc-shaped groove 211 of the lower portion 21 such that the pin 31 is able to slide along the arc-shaped groove 211 relative to the positioning board 3. A pivoting shaft 32 extends from a second side of the positioning board 3 opposite to the first side. The connecting portion 4 has a receiving hole 40 laterally defined therein and extending therethrough for receiving the pivoting shaft 32. A sleeve 321 is sleeved on the pivoting shaft 32 for assisting the pivoting shaft 32 to pivotally rotate relative to the connecting portion 4. A bolt 41 sequentially passes through the receiving hole 40 and the pivoting shaft 32, and is screwed to the lower portion 21 of the elbow joint 2, such that the desk board 1 is mounted on an outer side of the armrest 5. As shown in FIGS. 4 to 5, when the desk board 1 is not in use, the desk board 1 is suspended vertically beside the connecting portion 4, the positioning board 3 is located between the upper portion 20 and the lower portion 21, and is vertically disposed relative to the connecting portion 4. The pin 31 is abutted against a first end 2111 of the arc-shaped groove 211. The positioning board 3 blocks the pivoting lugs 22 of the upper portion 20 and the lower portion 21, such that the positioning board 3 confines the upper portion 20 from pivotally bending relative to the lower portion 21, thus the desk board 1 is stably suspended beside the connecting portion 4.

Figure 6:
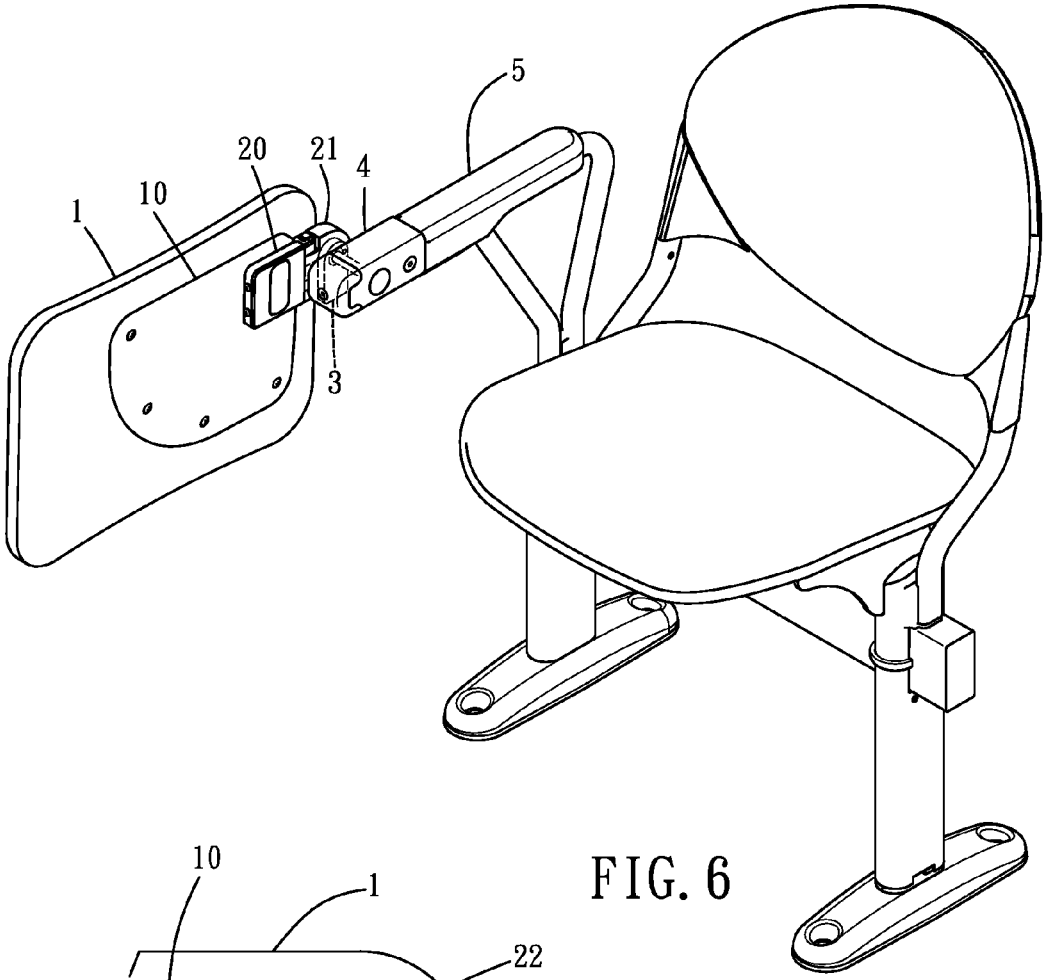
FIG. 6 and FIG. 8 are perspective views of the collapsible desk assembly in accordance with the present invention, showing the elbow joint and the desk board in upwardly pivoting positions.
Figure 7:
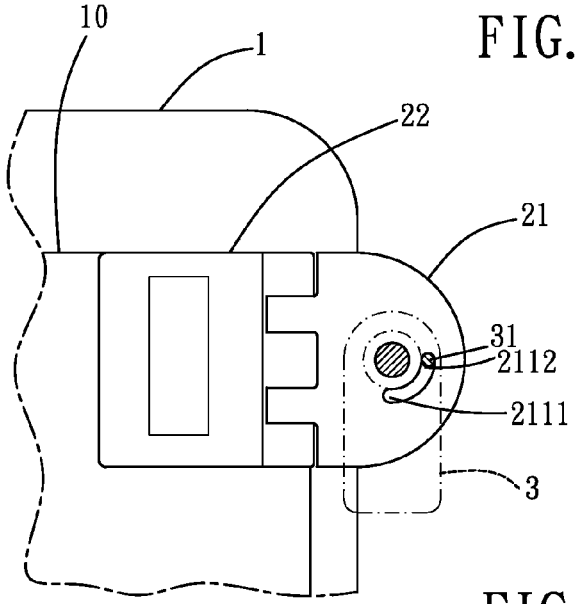
FIG. 7 and FIG. 9 are plane views of the elbow joint of the collapsible desk assembly in accordance with the present invention, showing the positions of the elbow joint relative to the desk board when the desk board and the elbow joint are in upwardly pivoting positions.
Figure 8:
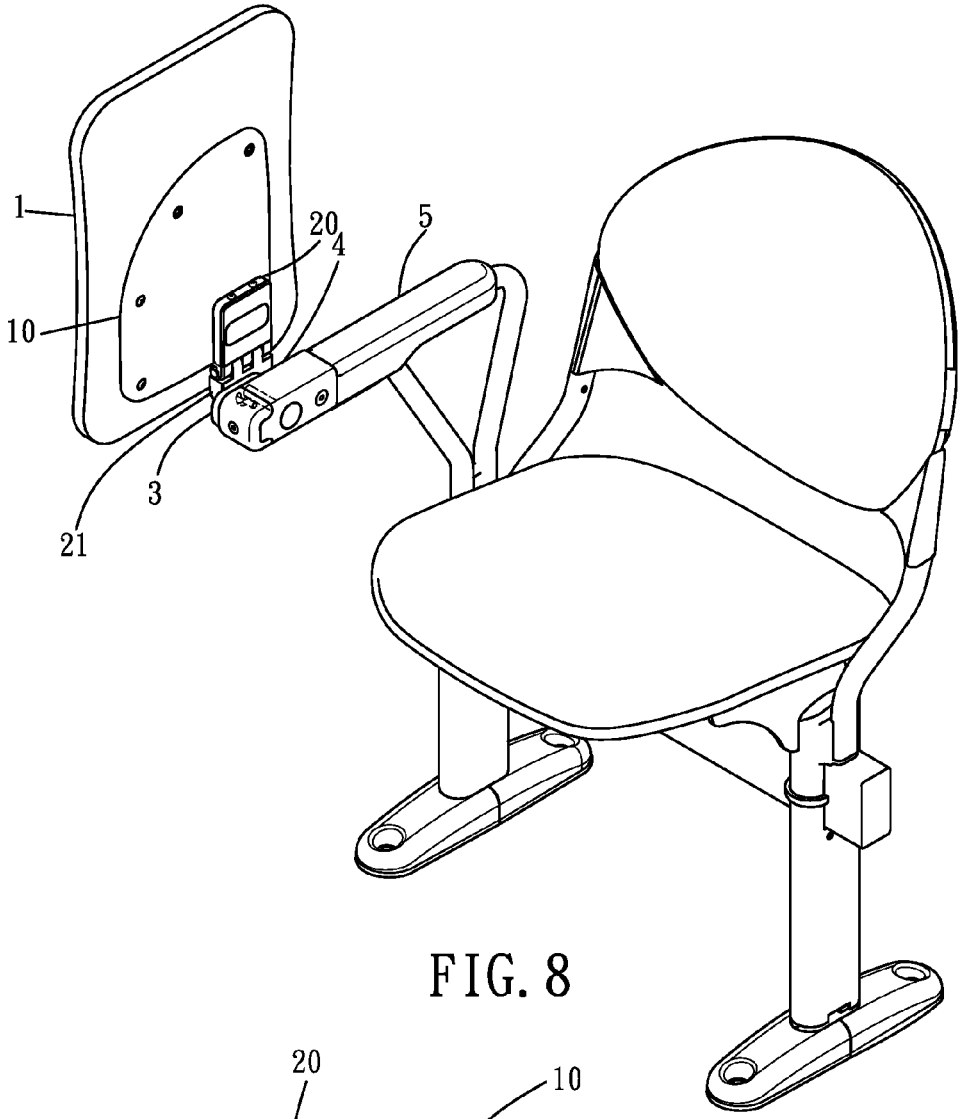
Figure 9:
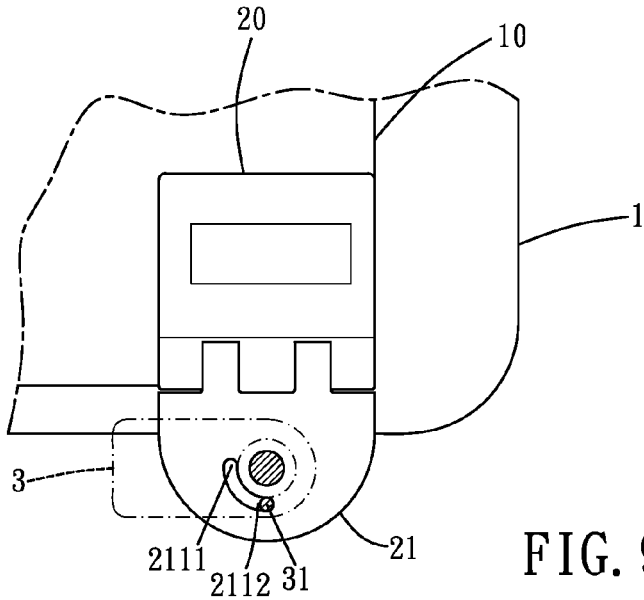
Figure 10:
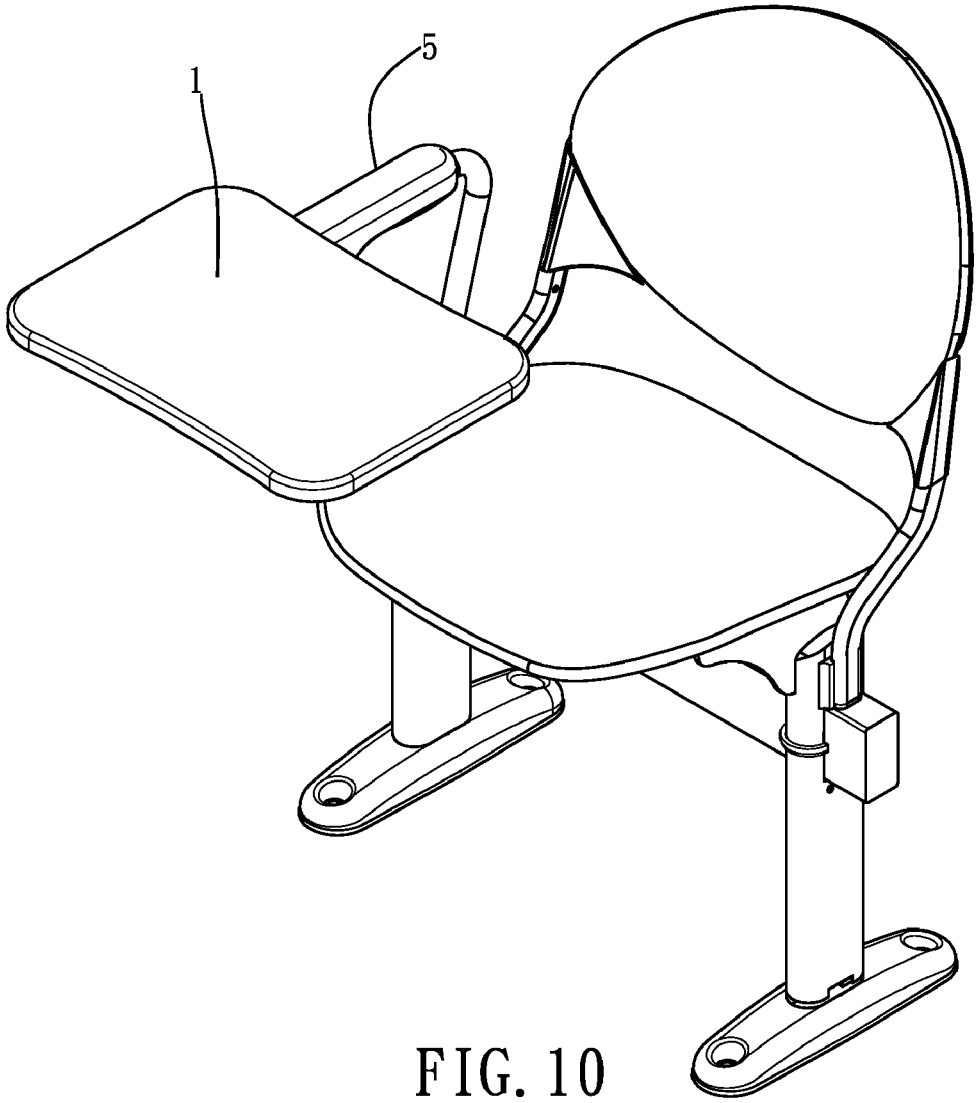
FIG. 10 is a perspective view of the collapsible desk assembly in accordance with the present invention, showing the desk board is flipped to a top of the connecting portion.
Figure 11:
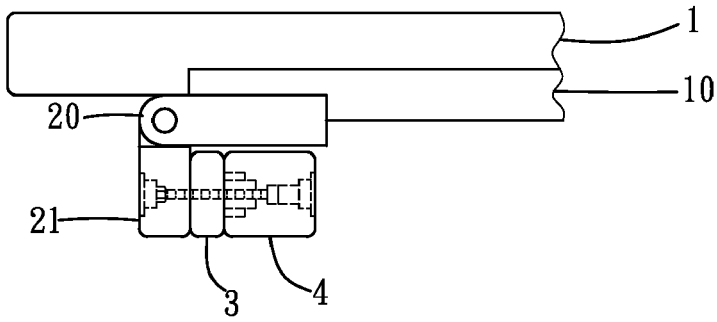
FIG. 11 is a plane view of the elbow joint and the desk board of the collapsible desk assembly in accordance with the present invention, showing the upper portion pivotally perpendicularly bent relative to the lower portion.

Referring to FIGS. 6 to 11, when the desk board 1 is upwardly lifted, the elbow joint 2 is pivotally rotated upwardly relative to the connecting portion 4. The pin 31 is slid from the first end 2111 of the arc-shaped groove 211 to a second end 2112 of the arc-shaped groove 211, and is abutted against the second end 2112 of the groove (as shown in FIGS. 6 to 7). Referring to FIGS. 8 to 11, as the elbow joint 2 continues to pivotally rotate upwardly, the pin 31 which is abutted against the second end 2112 of the arc-shaped groove 211 drives the positioning board 3 to pivotally upwardly rotate relative to the connecting portion 4. When the desk board 1 is lifted above the connecting portion 4, the upper portion 20 is pivotally perpendicularly bent relative to the lower portion 21, such that the desk board 1 is flipped to a top of the connecting portion 4, and is flatly placed above the connecting portion 4. Thus allows a user to use a front side of the desk board 1 for reading or writing purpose. When the desk board 1 is flipped to the top of the connecting portion 4, the positioning board 3 is located beside the lower portion 21 and is horizontally disposed relative to the connecting portion 4 and the lower portion 21 (as shown in FIG. 11), such that the upper portion 20 is freely pivotally bend relative to the lower portion.

Figure 12:
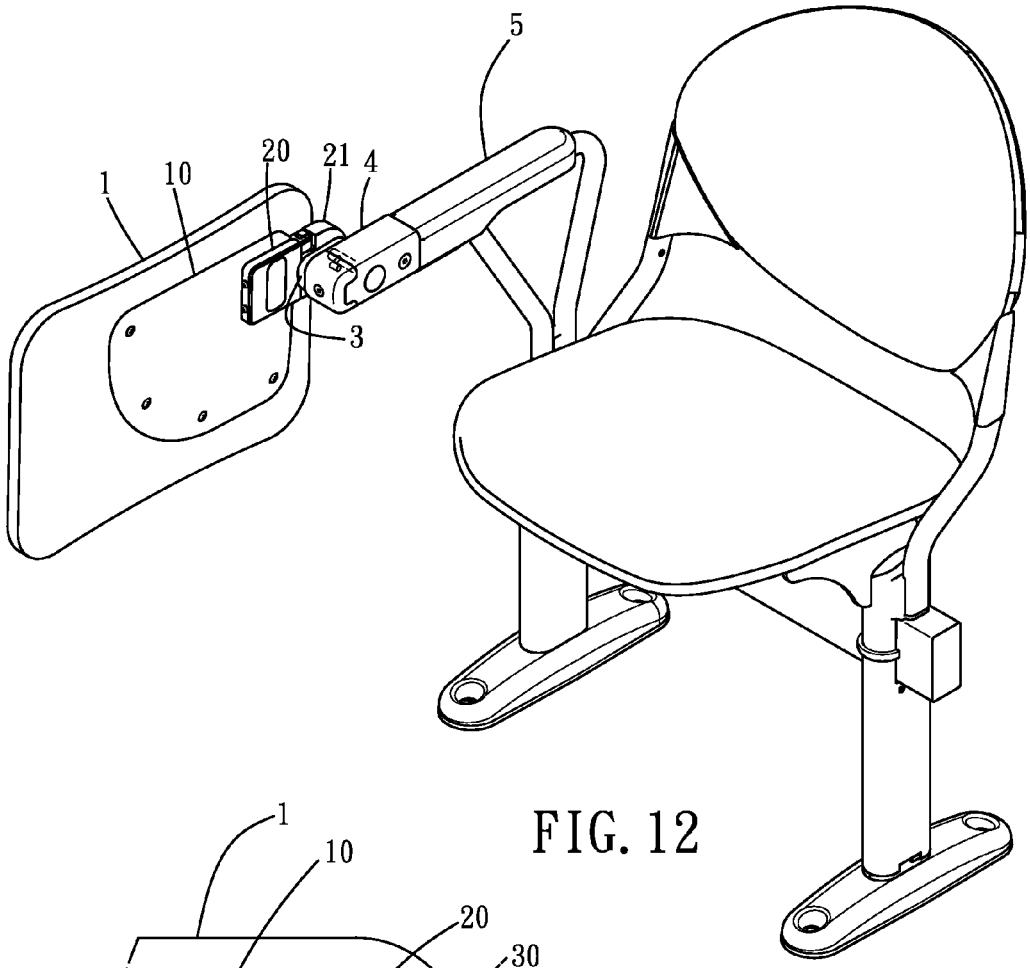
FIG. 12 is a perspective view of the collapsible desk assembly in accordance with the present invention, showing the elbow joint and the desk board in downwardly pivoting position.
Figure 13:
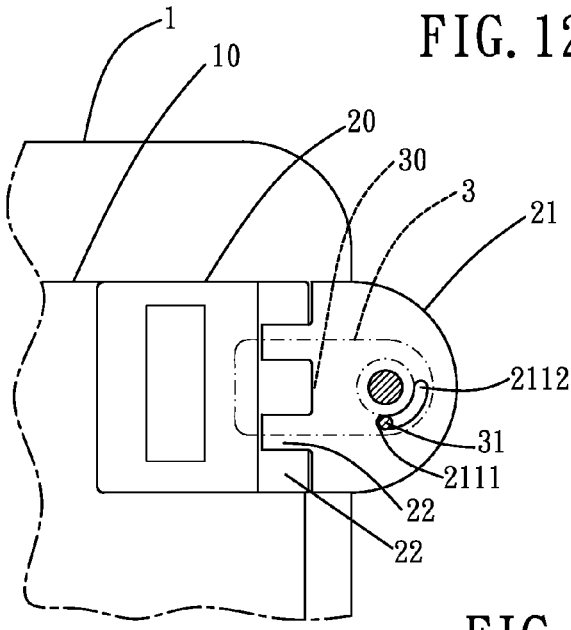
FIG. 13 is a plane view of the elbow joint of the collapsible desk assembly in accordance with the present invention, showing the position of the elbow joint relative to the desk board when the desk board and the elbow joint are in downwardly pivoting position.

Referring to FIGS. 12-13, when the desk board 1 is descended, the elbow joint 2 is pivotally rotated downwardly relative to the connecting portion 4. The pin 31 is then slid from the second end 2112 to the first end 2111 of the arc-shaped groove 211 of the lower portion 21. As the elbow joint 2 continues to pivotally rotate downwardly, the pin 31 which is abutted against the first end 2111 of the arc-shaped groove 211 drives the positioning board 3 to pivotally downwardly rotate relative to the connecting portion 4. The positioning board 3 is located between the upper portion 20 and the lower portion 21 and is vertically disposed relative to the connecting portion 4. The positioning board 3 blocks the pivoting lugs 22 of the upper portion 20 and the lower portion 21 and confined the upper portion 20 from pivotally bending relative to the lower portion 21, such that the desk board 1 is stably suspended when not in use (as referring back to FIGS. 4 to 5).

Figure 14:
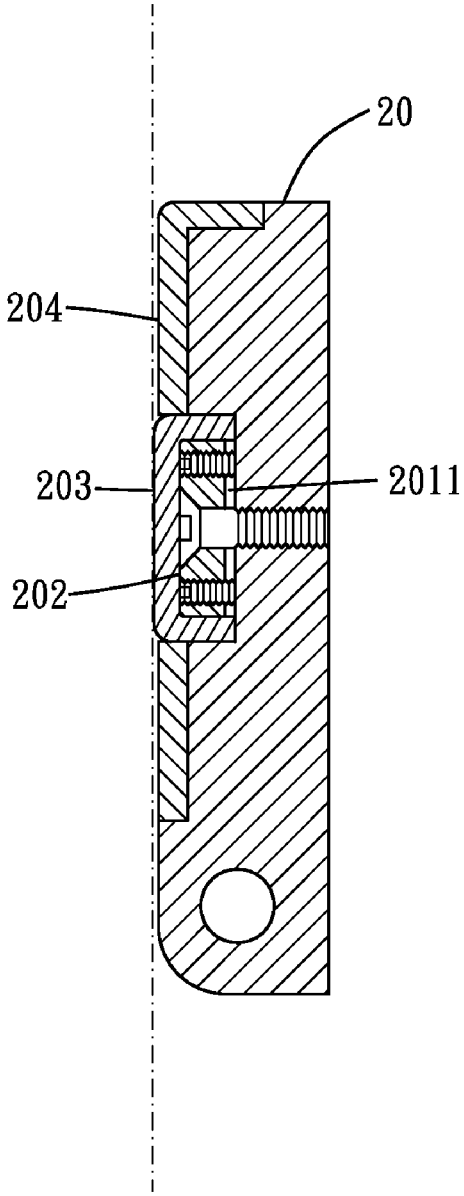
FIG. 14 and FIG. 15 are operational cross-sectional views of the upper portion of the collapsible desk assembly in accordance with the present invention; respectively showing the push block is screwed in and out from the cover casing.
Figure 15:
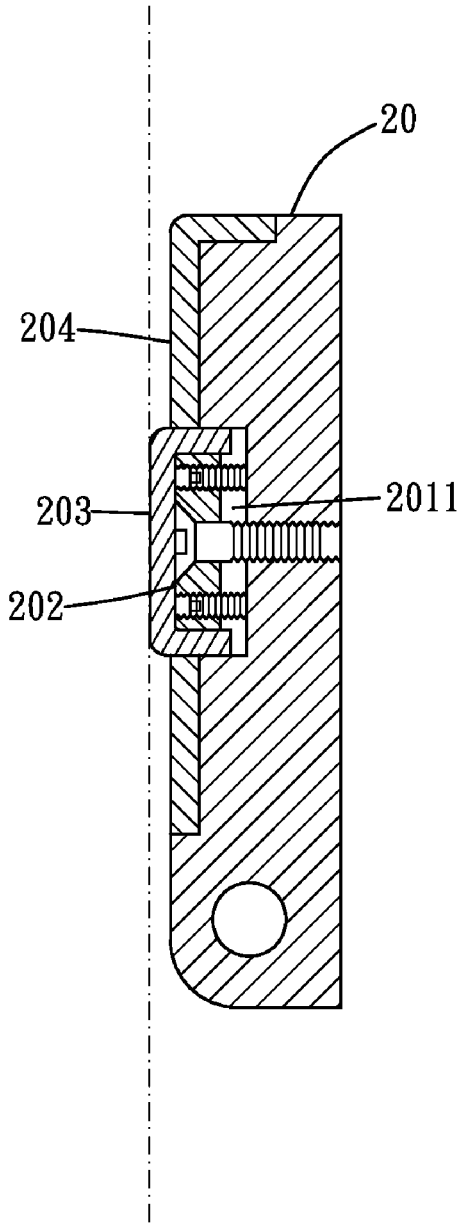

Referring to FIGS. 14-15, the push block 202 is screwed to the trench 2011 of the base 201 of the upper portion 20. A position of the block cover 203 with the push block 202 relative to the cover casing 204 is adjustable due to the push block 202 is screwed in/out from the trench 2011. As shown in FIG. 15, when the push block 202 is adjustably screwed toward the opening 2041 of the cover casing 204, the upper portion 20 is slightly pushed away from the connecting portion 4, such that the block cover 203 is protruded from the opening 2041 of the cover casing 204. An interval between the upper portion 20 and the connecting portion 4 is changed. Therefore, a tilting angle of the desk board 1 relative to the connecting portion is adjusted. A pivotal bending angle of the upper portion 20 relative to the lower portion 21 is also changed due to the change in the interval between the connecting portion 4 and the upper portion 20, such that the user is able to freely adjust the tilting angle of the desk board 1 by screwing in/out the push block 202 from the trench to fit his/her sitting postures, reading and/or writing habits.

Although the invention has been explained in relation to its preferred embodiment, it is to be understood that many other possible modifications and variations can be made without departing from the spirit and scope of the invention as hereinafter claimed.

What is claimed is:

1. A collapsible desk assembly comprising:

a desk board, the desk board provided for adapting to pivotally connect to an armrest of a chair;

an elbow joint mounted to a backside of the desk board, the elbow joint having an arc-shaped groove defined therein, the elbow joint pivotally perpendicularly bent;

a positioning board connected to the elbow joint, the positioning board having a pin disposed on a first side thereof, the pin inserted into the arc-shaped groove such that the pin is able to slide along the arc-shaped groove relative to the positioning board, a pivoting shaft extending from a second side of the positioning board opposite to the first side; and a connecting portion adapted to be connected to the armrest, the connecting portion having a receiving hole laterally defined therein and extending therethrough for receiving the pivoting shaft, a bolt sequentially passing through the receiving hole and the pivoting shaft, and screwed into the elbow joint;

the elbow joint including an upper portion and a lower portion pivotally connected to the upper portion; the upper portion mounted to the backside of the desk board, the lower portion threadedly connected to the connecting portion; a securing post simultaneously passing through the upper portion and the lower portion to be a pivot of the elbow joint;

the arc-shaped grooved positioned in the lower portion;

wherein when the desk board is pivotally lifted, the pin abutted against a second end of the arc-shaped groove, driving the positioning board to pivotally rotate upwardly; when the desk board descended, the pin abutted against a first end of the arc-shaped groove, driving the positioning board to pivotally rotate downwardly relative to the connecting portion, the positioning board blocking the elbow joint from pivotally bending relative to the connecting portion, such that the desk board is stably suspended beside the connecting portion;

furthermore when the elbow joint is pivotally rotated upwardly relative to the connecting portion, the desk board is upwardly lifted with the upper portion, when the desk board is lifted above the connecting portion, the upper portion is pivotally perpendicularly bent relative to the lower portion, such that the desk board is flipped to a top of the connecting portion; when the desk board is descended, the elbow joint and the positioning board is pivotally rotated downwardly relative to the connecting portion, the positioning board blocking the upper portion from pivotally bending relative to the lower portion, such that the upper portion is confined from arbitrarily pivoting relative to the lower portion when the desk board is descended.

2. The collapsible desk assembly as claimed in claim 1, further comprising a base mounted on the upper portion, the base has a trench defined therein, a push block screwedly received in the trench; a block cover capped the push block, and a cover casing completely covered the base, the cover casing having an opening defined therein for partially receiving the block cover, the block cover abutted against the connecting portion;

wherein an position of the block cover with the push block relative to the cover casing is adjustable due to the push block is screwed in/out from the trench; the upper portion is slightly pushed away from the connecting portion, such that the block cover is protruded from the cover casing, an interval between the upper portion and the connecting portion is changed, adjusting a tilting angle of the desk board relative to the connecting portion.

3. The collapsible desk assembly as claimed in claim 1, wherein the positioning board is elongated-shaped, a sleeve sleeving on the pivoting shaft for assisting the pivoting shaft to pivotally rotate relative to the connecting portion.

4. The collapsible desk assembly as claimed in claim 1, further comprising a supporting board mounted to the backside of the desk board, the supporting board having a receiving space defined therein for receiving the elbow joint.

* * * * *